US008196320B2

(12) United States Patent
Adami et al.

(10) Patent No.: US 8,196,320 B2
(45) Date of Patent: Jun. 12, 2012

(54) ARTICLE OF FOOTWEAR WITH INTERCHANGEABLE BOOTIE

(75) Inventors: Giovanni Adami, Montebelluna TV (IT); John Droege, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1267 days.

(21) Appl. No.: 11/876,183

(22) Filed: Oct. 22, 2007

(65) Prior Publication Data

US 2009/0100713 A1 Apr. 23, 2009

(51) Int. Cl.
*A43B 3/24* (2006.01)
*A43B 5/02* (2006.01)

(52) U.S. Cl. ..... 36/100; 36/133

(58) Field of Classification Search ..... 36/99, 100, 36/101, 133
See application file for complete search history.

(56) References Cited

U.S. PATENT DOCUMENTS

| | | | | |
|---|---|---|---|---|
| 155,968 | A | 10/1874 | Owens | |
| 997,365 | A | 7/1911 | Drake | |
| 3,525,165 | A | 8/1970 | Randall, Jr. | |
| 3,858,337 | A | 1/1975 | Vogel | |
| 4,132,016 | A | 1/1979 | Vaccari | |
| 4,887,369 | A | 12/1989 | Bailey et al. | |
| 5,339,544 | A | 8/1994 | Caberlotto | |
| 5,367,791 | A | 11/1994 | Gross et al. | |
| 5,528,841 | A | 6/1996 | Pozzobon | |
| 5,737,858 | A | 4/1998 | Levy | |
| 5,855,079 | A * | 1/1999 | Herbert | 36/88 |
| 5,897,446 | A | 4/1999 | Wiseman et al. | |
| 6,023,859 | A | 2/2000 | Burke et al. | |
| 6,038,792 | A | 3/2000 | Hauter | |
| 6,922,919 | B2 | 8/2005 | Chenevert | |
| 7,010,872 | B2 | 3/2006 | Pawlus et al. | |
| 7,140,129 | B2 | 11/2006 | Newson et al. | |
| 7,591,084 | B2 * | 9/2009 | Santa Ana | 36/100 |
| 2004/0128863 | A1 * | 7/2004 | Hong et al. | 36/100 |
| 2005/0022430 | A1 | 2/2005 | Terry | |
| 2005/0144812 | A1 | 7/2005 | Wheeler | |
| 2005/0172516 | A1 * | 8/2005 | Dalbec | 36/100 |
| 2005/0188562 | A1 * | 9/2005 | Clarke et al. | 36/15 |

FOREIGN PATENT DOCUMENTS

| | | |
|---|---|---|
| EP | 0 029 794 | 6/1981 |
| EP | 0 496 931 | 8/1992 |
| EP | 1 430 800 | 6/2004 |
| JP | 9-140402 | 6/1997 |
| WO | WO 96/32856 | 10/1996 |

OTHER PUBLICATIONS

International Search Report and Written Opinion, mailed Jan. 30, 2009, from PCT Application No. PCT/US2008/080612.
International Preliminary Report on Patentability mailed May 6, 2010 in PCT Application No. PCT/US2008/080612.

* cited by examiner

*Primary Examiner* — Khoa Huynh
*Assistant Examiner* — Sharon M Prange
(74) *Attorney, Agent, or Firm* — Plumsea Law Group, LLC

(57) ABSTRACT

An article of footwear can receive a bootie. The article can include an upper to receive the bootie. Ball control elements may be provided on the bootie and the ball control elements can extend through the upper. The ball control elements can be configured to aid kicking or to interact with various surfaces. The upper can receive different booties having different ball control elements.

25 Claims, 9 Drawing Sheets

ARTICLE OF FOOTWEAR WITH INTERCHANGEABLE BOOTIE

BACKGROUND OF THE INVENTION

1. Field of the Invention

The invention relates to articles of footwear, and more particularly, articles of footwear having replaceable booties with ball control elements.

2. Background of the Invention

Many sports require interaction between an athletic shoe upper and another surface. For example, in soccer, rugby, and football, players kick a ball with their foot. The point of contact where the athletic shoe touches the other surface can be referred to as an interaction surface. In addition, in rock climbing, a climber relies on friction from different portions of climbing shoes. In the past, participants in these sports were limited by the shoe they are wearing. Each pair of shoes was limited to have only one type of interaction surface.

Recently, ball control elements have been introduced. Ball control elements can be attached to a shoe to create a shoe that has a modified interaction surface. For example, a soccer style shoe having a ball control element on the foreheel can have a refined kicking performance at the forefoot portion. For example, Japanese Patent Number JP9140402, to Saburo, is directed to an athletic shoe having ball control elements that are placed within the upper, however, the athletic shoe of Saburo only has one set of ball control elements.

Some athletic shoes are designed to receive inserts to accommodate changes in running styles or to replace treads. For example, U.S. Pat. No. 6,023,859, to Burke et al. discloses a shoe that receives sole inserts. The sole inserts can be replaced and configured for different running styles, like over-pronation. The inserts extend through holes in the sole, and are inserted from outside the shoe.

SUMMARY

Embodiments can include an article of footwear, including a bootie, a shell configured to receive the bootie, a ball control element provided on the bootie, and a ball control passage defined in the shell, wherein the ball control element is aligned with the ball control passage and wherein the ball control element extends outward from the ball control element passage when the bootie is received in the shell.

In another aspect, the bootie comprises a sole and a foot cover, wherein the foot cover is attached to the sole and configured to receive a foot.

In another aspect, the sole includes at least one tread element provided on a bottom surface of the sole.

In another aspect, the tread element is configured to be associated with an inner surface of the shell.

In another aspect, the sole includes a reinforcement member configured to strengthen the sole.

In another aspect, the sole includes a cushioning member.

In another aspect, the foot cover is configured to at least partially cover the foot.

In another aspect, the bootie is configured to be worn separately from the shell.

In another aspect, the shell includes a shell upper and a shell sole, and wherein the ball control passage is defined in the shell upper.

In another aspect, the article of footwear includes an additional ball control element provided on an outer surface of the shell.

In another aspect, the invention provides a method for assembling an article of footwear having a ball control passage defined in an upper of the article, the method comprising the steps of: selecting a bootie from a group of candidate booties, each bootie in the group of candidate booties having a ball control element provided on an outer surface of the bootie; and associating the selected bootie with an interior of the upper so that the ball control element extends through the ball control passage.

In another aspect, the ball control element of at least one bootie in the group of candidate booties includes is configured with characteristics selected from the group consisting of enhanced performance in wet conditions, increased power in kicking, and increased accuracy in kicking.

In another aspect, the method includes selecting a shell from a group of candidate shells, wherein the shell forms the upper of the article of footwear.

In another aspect, the invention provides an article of footwear comprising a shell having a sole and an upper attached to the sole, a group of booties, a ball control element provided on the booties, a ball control passage provided in the upper to receive the ball control element, wherein each of the booties is configured to be received in the upper and wherein each bootie of the group of booties is manufactured to have a different style of ball control element so that the booties may be interchanged with each other to accommodate different playing conditions.

In another aspect, the sole includes a cleat.

In another aspect, the group of booties includes a bootie having ball control elements configured with characteristics selected from the group consisting of accommodating wet conditions, increasing the power of kicking, increasing the accuracy of kicking, facilitating rock climbing, contacting a football, and contacting a soccer ball.

In another aspect, the article of footwear also includes an additional ball control element provided on the bootie and an additional ball control passage provided in the upper, wherein each ball control element is configured to be associated with a corresponding ball control passage when the bootie is received by shell.

In another aspect, the article of footwear also includes a plurality of lacing elements disposed on the shell, wherein the lacing elements are configured to receive a shoelace for adjusting the fit of the shell.

In another aspect, the shoelace is threaded through the lacing elements to avoid the ball control element.

In another aspect, the shoelace extends between the ball control element and an adjacent ball control element.

Other configurations, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views. In the drawings.

DETAILED DESCRIPTION

Embodiments of the present invention provide an article of footwear having interchangeable ball control elements. In particular, ball control elements are provided on a bootie. A user can select among different booties having different ball control elements and the article can receive the different types of booties. Thus, the ball control elements for an article can be easily changed by simply changing the bootie.

Figure 1:
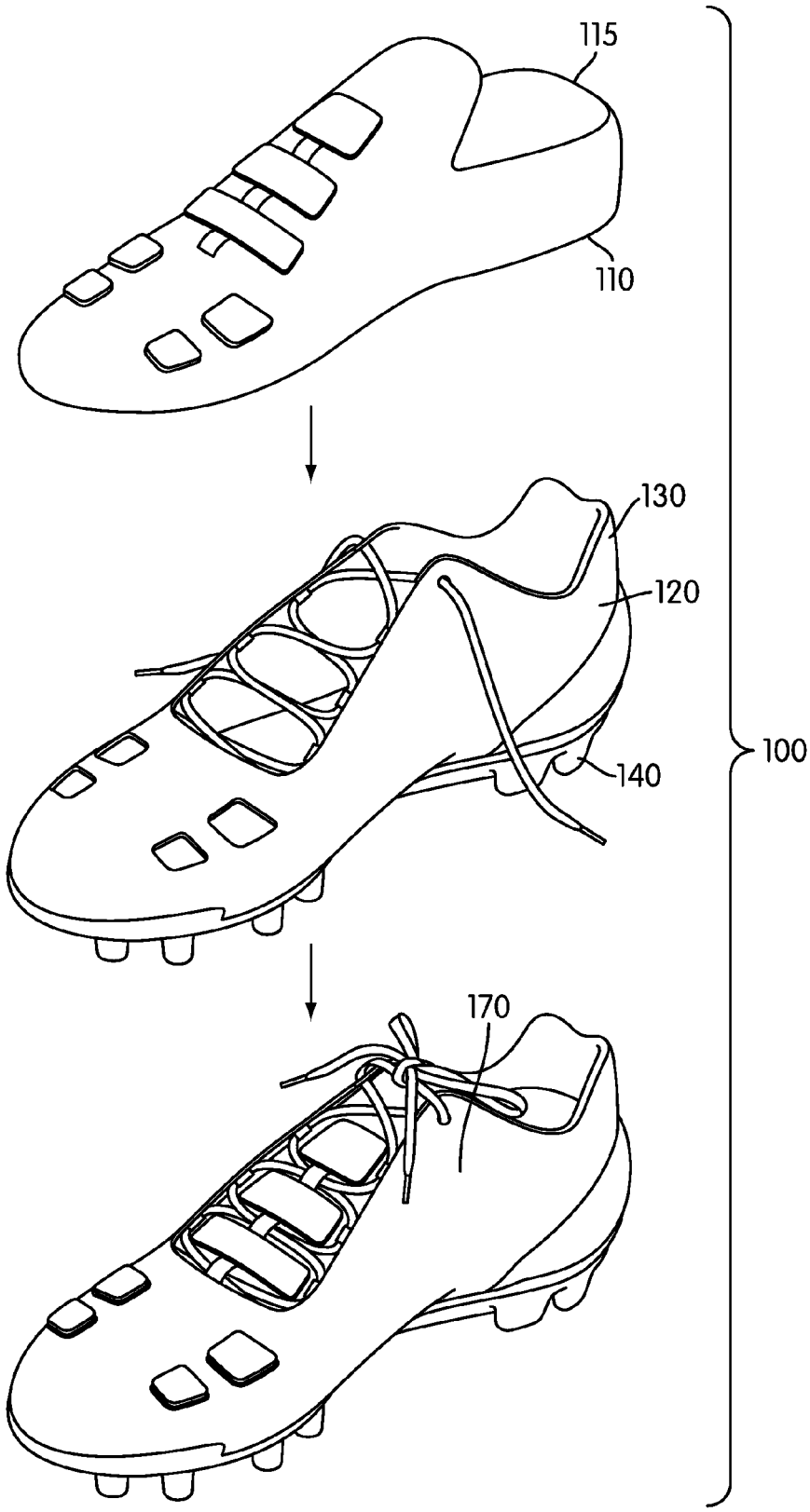
FIG. 1 is a schematic diagram illustrating article of footwear 100 according to a preferred embodiment.

FIG. 1 is a diagram of a preferred embodiment of footwear 100. Referring to FIG. 1, article 100 preferably includes bootie 110 and shell 120. For clarity, the following detailed description discusses a preferred embodiment, however, it should be kept in mind that the present invention could also take the form of any other kind of footwear including, for example cycling shoes, athletic shoes, climbing shoes, or any other kind of footwear.

Preferably, shell 120 includes upper 130 and sole 140. Upper 130 is associated with sole 140. Upper 130 is preferably attached to sole 140. Upper 130 can be attached to sole 140 by an adhesive, stitching, or any other suitable connection.

Upper 130 may assume any shape, including varying heights and widths. In some embodiments, upper 130 can be configured as a low top shoe. Other embodiments of upper 130 can include high top configurations.

Sole 140 can preferably include an outer surface configured to contact the ground. In some embodiments, the outer surface can include tread or cleats. Preferably, sole 140 is configured to support a foot of a user and to bend as the foot moves. Sole 140 can be constructed from rubber, plastic, leather, or any other suitable material.

Preferably, bootie 110 is received in shell 120. Bootie 110 is configured to be inserted into shell 120. After bootie 110 is inserted into shell 120, a foot can then be inserted into article of footwear 100 to complete assembled configuration 170. In another embodiment, assembled configuration 170 can be assembled by having the foot first inserted into bootie 110, and then the foot and bootie 110 may be inserted into shell 120 together. Accordingly, shell 120 can be configured to have an interior that can receive bootie 110 and bootie 110 can have an exterior shape that is complementary to the interior shape of shell 120. In other embodiments, bootie 110 is preferably placed into shell 120 before article 100 is placed on the foot.

Figure 2:
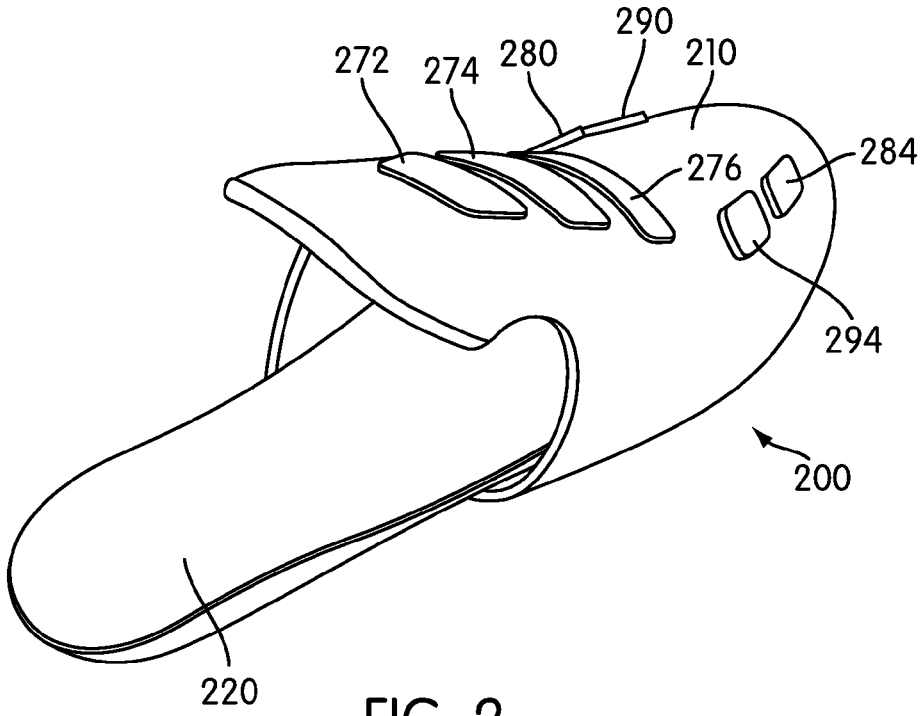
FIG. 2 is a schematic diagram illustrating a preferred embodiment of a bootie.

FIG. 2 is a diagram illustrating a preferred embodiment of bootie 200. Referring to FIG. 2, bootie 200 preferably includes foot cover 210 and foot pad 220. Foot cover 210 is associated with foot pad 220. Foot cover 210 can be attached to foot pad 220 by an adhesive, stitching, or any other suitable connection.

Foot cover 210 and foot pad 220 are preferably configured to receive a foot. Foot cover 210 is generally designed to engage a top portion of a foot and foot pad 220 is generally designed to engage a bottom portion of the foot. In some embodiments, foot cover 210 preferably covers only a portion of the foot. In other embodiments, foot cover 210 can cover the entire foot. For example, referring to FIG. 1, bootie 110 illustrates an embodiment in which bootie 110 includes upper 115 that covers and secures a complete circumference of a portion of a foot. In some embodiments, a bootie can use straps, ties, flaps, toe holds, ankle wraps, or any other suitable device to secure the bootie to a foot.

Returning to FIG. 2, foot pad 220 provides support for a foot. Preferably, foot pad 220 is sized to correspond with a particular size of foot. Accordingly, foot pad 220 provides a surface that can accommodate the heel, toes, instep, and ball portion of a particular size of foot.

In some embodiments, bootie 200 can be configured to be worn as a slipper or sandal when not inserted into a shell. Accordingly, bootie 200 can be comfortably worn without a shell. For example, an athlete can wear bootie 200 until game time, or during an intermission, and then insert bootie 200 into a shell configured to receive bootie 200.

In other embodiments, a foot pad portion of a bootie could cover less than the bottom of the foot to be received. For example, in some embodiments, a foot pad may only cover the toes and balls of the foot. Other embodiments may provide support to only a select portion of the bottom of the foot.

Figure 3:
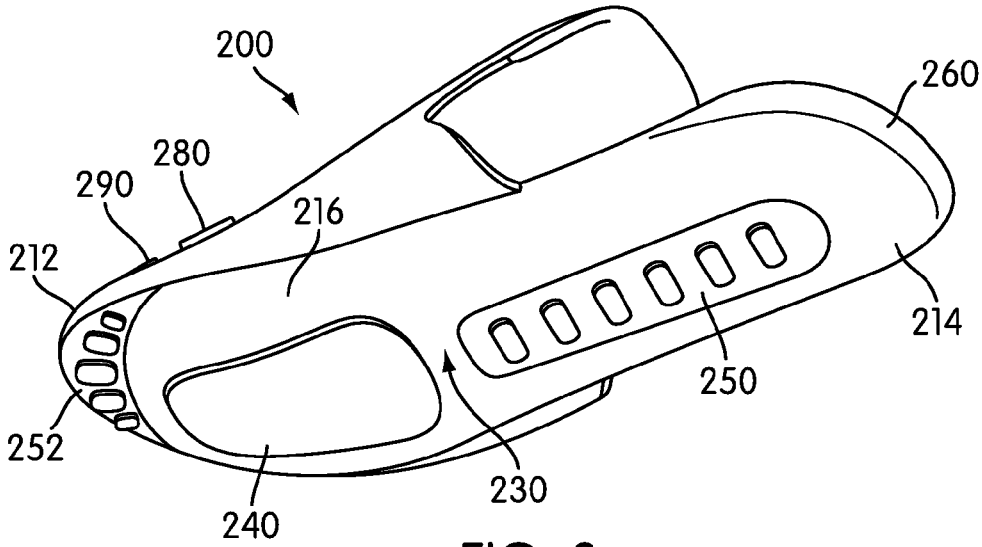
FIG. 3 is an schematic illustration of the bottom of the bootie of FIG. 2.

FIG. 3 is a schematic diagram of bottom 230 of foot pad 220. Bottom 230 can include provisions to increase comfort and to improve its ability to associate with shell 120. Referring to FIG. 3, bottom 230 preferably includes cushion 240, tread 250, forefoot tread 252, and reinforcement 260. In some embodiments, a foot pad may include any combination and arrangement of cushions, tread, or reinforcement.

Cushion 240 is preferably a cushioning material provided within foot pad 220. Cushion 240 can absorb impacts while bootie 200 is worn alone or when bootie 200 is received in a shell, such as shell 120 of FIG. 1. In some embodiments, cushion 240 can be provided at any of toe portion 212, heel portion 214, or balls of the foot 216.

In some embodiments, cushion 240 can have different configurations. For example, in some embodiments, cushion 240 can extend from bottom 230 of foot pad 220. In other embodiments, cushion 240 is flush with bottom 230 and does not extend past bottom 230. Additionally, cushion 240 can be patterned. For example, cushion 240 can be patterned as a tread formation.

Tread 250 is preferably an area of foot pad 220 that can engage either the ground or a bootie. Tread 250 can be provided at any location on the bottom of foot pad 220. For example, forefoot tread 252 can be provided in toe portion 212 of bootie 200. Tread 250 can preferably have a tread pattern.

Tread 250 can preferably allow bootie 200 to associate more securely with a shell. While inside a shell, tread 250 can grip the inside surface of the shell to prevent slipping within the shell and limit in-shell movement of bootie 200. In some embodiments, the shell can include portions that interact with tread 250 to further enhance stability of bootie 200 in the shell.

In addition, tread 250 can allow bootie 200 to be worn separately from a shell. Tread 250 can provide traction on grass, or other surfaces where bootie 200 may be worn separately from a shell. Tread 250 can allow the wearer to walk or run securely when wearing only bootie 200.

Reinforcement 260 is preferably provided on edges of foot pad 220. Reinforcement 260 can be located at any portion of foot pad 220 where extra resiliency may be required. For example, reinforcement 260 may be provided at a location where foot pad 220 could rub against the interior of a bootie. Reinforcement 260 can be constructed of hard plastic, rubber, leather or any other suitable reinforcing material.

Figure 4:
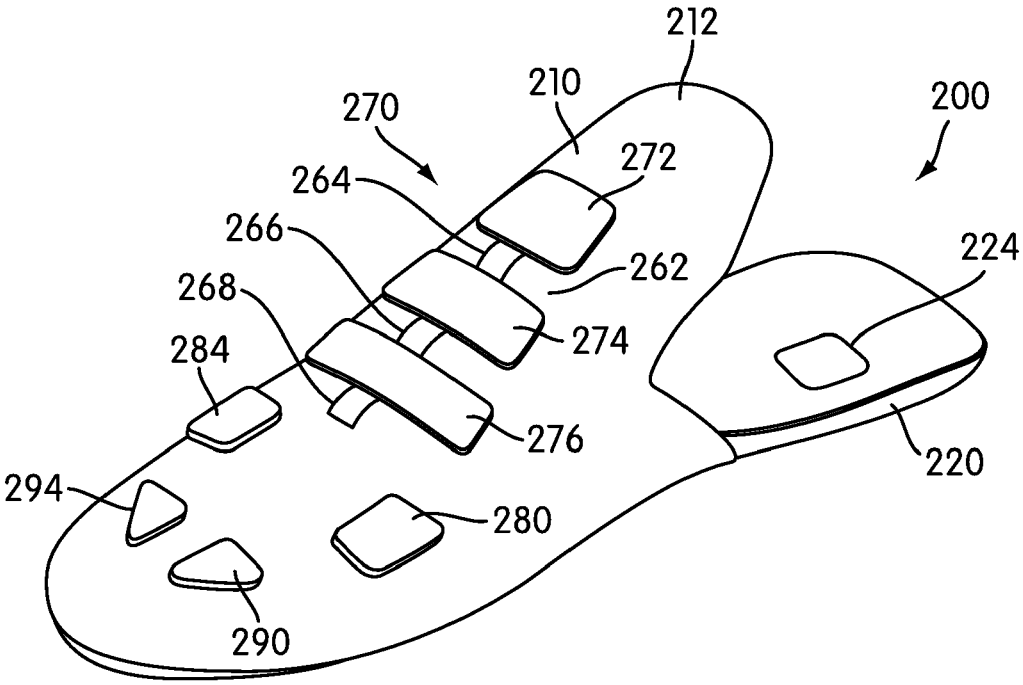
FIG. 4 is an isometric view of the bootie of FIG. 2.

FIG. 4 is a schematic diagram of a preferred embodiment of bootie 200. Referring to FIG. 4, foot cover 210 preferably includes a plurality of ball control elements. Bootie 200 can also include logo 224. In particular, the ball control elements can include lace ball control group 270. Lace ball control group 270, in some embodiments, can include first lace section 264, second lace section 266, and third lace section 268. In other embodiments, more or less lace elements may be provided.

In addition, foot cover 210 can preferably include medial element 280, lateral element 284, lateral forefoot element 294, and medial forefoot element 290. The configuration of ball control elements shown in FIG. 4 is merely an example. Depending of the embodiment, bootie 200 can contain any combination or arrangement of ball control elements. That is, the arrangements of the ball control elements as illustrated should not be read to limit the type, size, shape, or configuration of the ball control elements on a bootie. For example, an article configured for punting footballs may include few, larger ball control elements. In addition, articles configured for rock climbing may have soft or treaded ball control elements provided around the circumference of the article.

Bootie 200 can also include lace securing portion 262. Lace securing portion 262 can receive a lace between the ball control elements. Lace securing portion 262 can include first lace section 264, second lace section 266, and third lace section 268. First lace section 264 can be provided between first ball control element 272 and second ball control element 274. Second lace section 266 can be provided between second ball control element 274 and third ball control element 276. Additionally, third lace section 268 can be provided below third ball control element 276. Additional lace sections can be provided to receive the shoelace.

In some embodiments, the ball control elements can be disposed in locations where the article of footwear will interact with a surface. For example, in embodiments in which the article is intended to kick balls on the forefoot, larger ball control elements can be placed on the forefoot. In an embodiment directed to rock climbing, control elements for rock climbing can be provided at the tips and sides of the article. In other embodiments of articles directed to soccer-style kicking, ball control elements can be placed on the medial and lateral sides of bootie 200.

Figure 5:
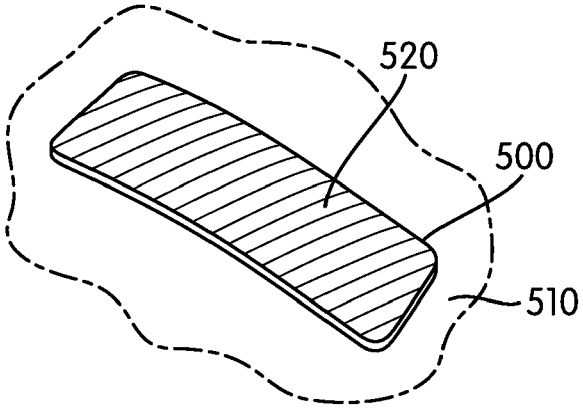
FIG. 5 is a enlarged view of a ball control element according to an embodiment.

FIG. 5 is an enlarged schematic diagram of a preferred embodiment of ball control element 500. Referring to FIG. 5, ball control element 500 can be associated to bootie 510. Preferably, ball control element 500 includes ball control surface 520. Ball control surface 520 is preferably provided on an outer portion of ball control element 500. Ball control surface 520 has a predetermined property to interact with a surface in a predetermined manner. Ball control element 500 should be understood to illustrate a generic example of a ball control element. Accordingly, ball control element 500 can be formed in any desired shape or size and can have any desired surface. For example, a ball control element can have a hard surface to improve kicking power or a ball control element can have a softer stickier surface to improve kick accuracy.

Preferably, the surface that ball control surface 520 interacts with is the surface of a ball. In some embodiments, ball control surface 520 can be configured to tightly grip or otherwise interact with a known surface of a type of ball, such as a soccer ball. In other embodiments, the ball can be another type of ball, for example, a football. In other embodiments, ball control surface 520 is configured to interact with another type of object. For example, ball control surface 520 can be configured to interact with a rock surface in a rock climbing embodiment.

Preferably, ball control element 500 can be selected based on a number of factors. For example, ball control element 500 can be selected based on the ball control quality of ball control surface 520. In some embodiments, ball control surface 520 is configured to provide a tight grip to a ball. In other embodiments, ball control surface 520 is configured to have a slippery interaction with a ball. In other embodiments, ball control surface 520 is selected based on how well ball control surface interacts with a ball in a wet environment.

In some embodiments, ball control element 500 can be harder to provide more power to a kick. In other embodiments, ball control element 500 can be configured to provide a kicker with more accuracy. In other embodiments, such as in rock climbing, ball control element 500 can be configured to have a predetermined grip. In addition, in some embodiments, ball control surface 520 can be configured to have a rough tread surface.

In addition, in some embodiments, ball control element 500 can be selected on a basis of size. For example, ball control element 500 can be designed to extend from a corresponding shell. In other example, ball control element is selected to be flush with a corresponding shell. In some embodiments, ball control element 500 has a large size to provide a large contact area while in other embodiments, a smaller contact area is desired.

Figure 6:
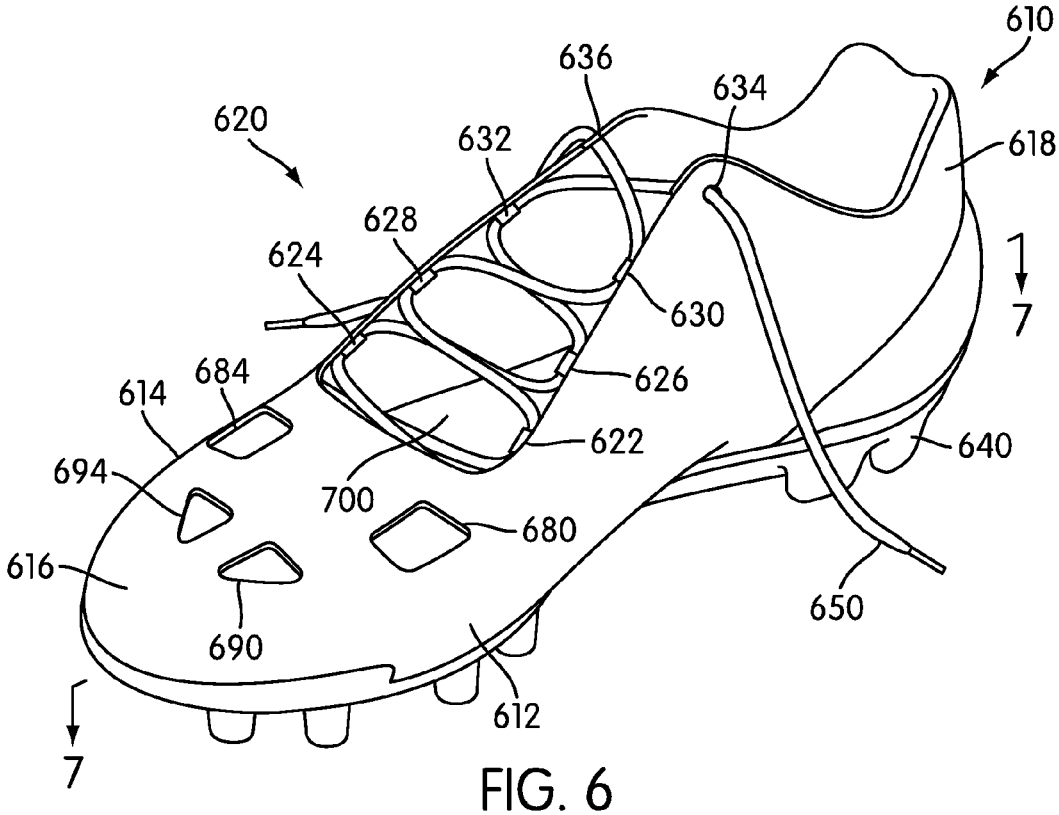
FIG. 6 is a schematic diagram of a shell according to another embodiment.

FIG. 6 is a schematic diagram of a preferred embodiment of article 610. Referring to FIG. 6, article 610 is configured to receive a bootie, for example bootie 200 of FIG. 2. Similar to shell 120 of FIG. 1, article 610 preferably includes upper 618 and sole 640. Preferably, article 610 includes provisions to accommodate one or more ball control element. That is, article 610 can preferably receive a bootie having ball control elements, and article 610 preferably exposes the ball control elements.

As shown in FIG. 6, the ball control element provisions can include ball control passages defined in upper 618. The ball control passages can include medial ball control passage 680 that is preferably provided in the medial side 614 of article 610. Lateral ball control passage 684 is preferably provided in the lateral side 612 of article 610. Medial forefoot passage 690 and lateral forefoot passage 694 are each preferably provided in the front portion 616 of article 610.

Article 610 preferably includes lace element group 620. Lace element group 620 is preferably configured to receive and direct shoelace 650 around the ball control elements on the bootie to be received. In some embodiments, lace element group can preferably be configured to receive first ball control element 272, second ball control element 274, and third ball control element 276 of bootie 200 of FIG. 2 between shoelace 650. In a preferred embodiment, a lace element group can be arranged depending on the bootie configuration.

In some embodiments, lace element group 620 preferably includes first portion 622 and second portion 624. Shoelace 650 preferably extends from between first portion 622 and second portion 624 to extend to both sides of lace element group 620. First portion 622 preferably directs shoelace 650 to third portion 626 and second portion 624 preferably directs shoelace 650 to fourth portion 628. In some embodiments, the lace portions can direct shoelace 650 straight across element group 620 while in other embodiments, the lace portions can direct shoelace 650 any direction, including vertically, horizontally, and diagonally.

Shoelace 650 emerges from third portion 626 and can preferably extend diagonally across lace element group 620 to sixth portion 632. Shoelace also emerges from fourth portion 628 and can preferably extend to fifth portion 630. Shoelace 650 then extends from fifth portion 630 and can preferably first shoelace hole 634. Shoelace 650 can preferably extend from sixth portion 632 to second shoelace hole 636. Shoelace 650 emerges from first hole 634 and second hole 636 and may then be tied.

First portion 622, second portion 624, third portion 626, fourth portion 628, fifth portion 630, and sixth portion 632 of lace element group 620 can each be configured to guide shoelace 650 around a received ball control element.

Depending on the embodiment, lace element group 620 can contain any combination or arrangement of lace portions. That is, the arrangement of the lace portions as illustrated should not be read to limit the type, size, shape, or configuration of the lace portions of a lace control group on a shell. Preferably, a lace control group is configured to guide a shoelace around or between ball control elements provided on the tongue of a bootie. Accordingly, lace portions preferably guide the shoelace vertically over a corresponding ball control element.

Figure 7:
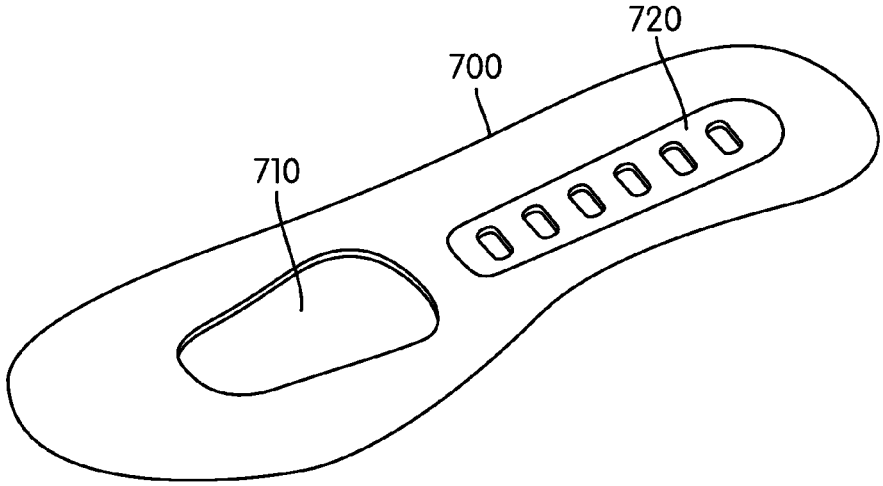
FIG. 7 is a diagram of the article of FIG. 2.

FIG. 7 is a schematic diagram of a preferred embodiment of top surface 700 of sole 640. Referring to FIG. 7, top surface 700 is preferably configured to receive foot pad 220 of bootie 200. Sole 640 preferably includes forefoot contact portion 710 and heel contact portion 720. Referring to FIGS. 2 and 7, forefoot contact portion 710 and heel contact portion 720 can associate with the bottom surface of foot pad 220 to stabilize bootie 200 in article 610. In particular, heel contact portion 720 can associate with tread 250 of bootie 200. Forefoot contact portion 710 can associate with cushion 240 of bootie 200.

Returning to FIG. 7, top surface 700 can be configured to receive any desired bootie embodiment. Depending on the embodiment, forefoot contact portion 710 and heel contact portion 720 can associate with a food pad of a received bootie in a variety of configurations. In one embodiment, forefoot contact portion 710 and heel contact portion 720 can be configured as indentations in sole 640. In other embodiments, forefoot contact portion 710 and heel contact portion 720 can have tread portions that match the tread or cushion of a received bootie. Alternatively, in some embodiments, forefoot contact portion 710 and heel contact portion 720 can extend from sole 640 to be received by a foot pad of the received bootie.

Figure 8:
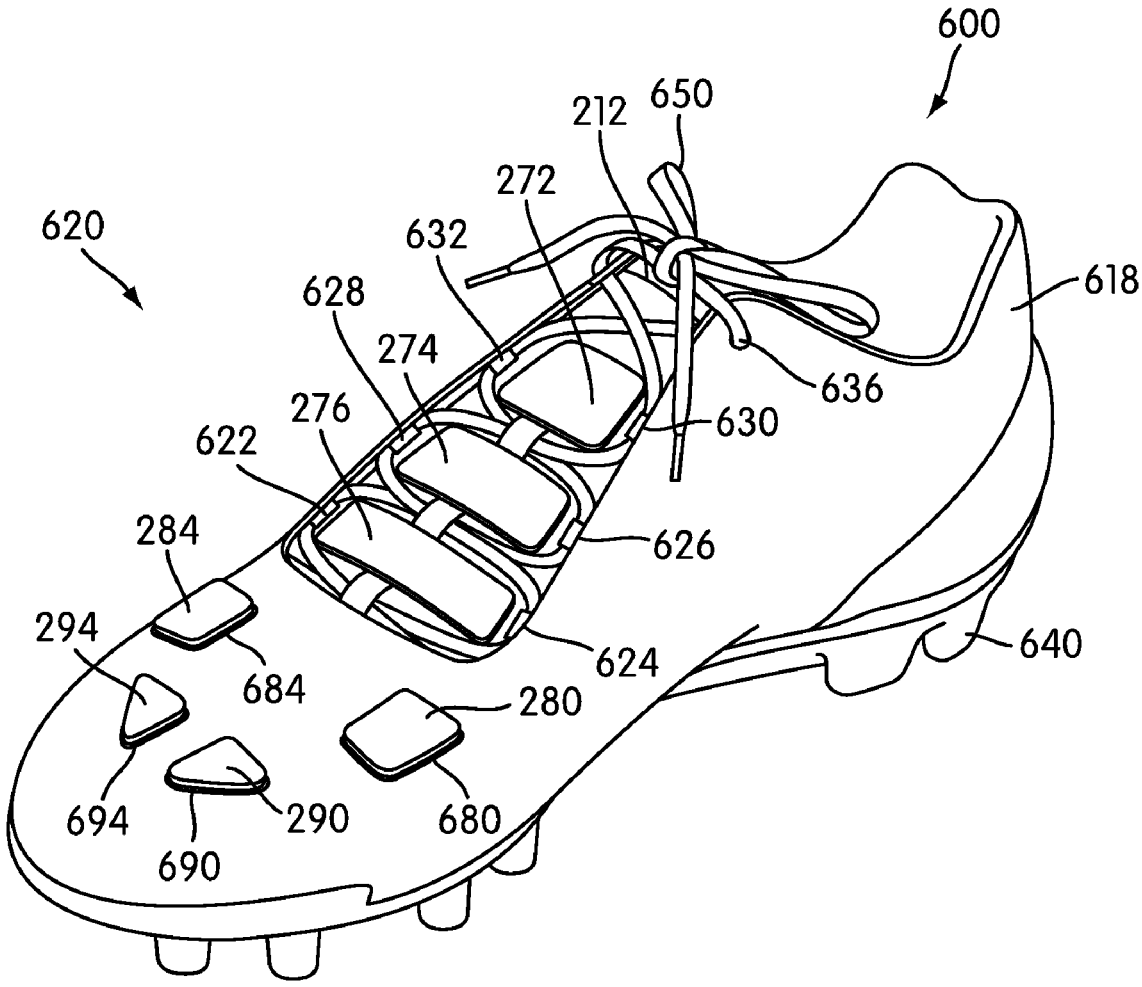
FIG. 8 is a diagram of an embodiment of the sole of FIG. 6.

FIG. 8 is a schematic diagram of a preferred embodiment of article 610 after assembly. Referring to FIG. 8, first ball control element 272 preferably corresponds to first portion 622 and second portion 624; second ball control element 274 preferably corresponds to third portion 626 and fourth portion 628; third ball control element 276 preferably corresponds to fifth portion 630 and sixth portion 632; lateral element 284 preferably corresponds to lateral ball control passage 684; and medial element 280 preferably corresponds to medial ball control passage 680. In addition, medial forefoot element 290 preferably corresponds to medial forefoot passage 690 and lateral forefoot element 294 preferably corresponds to lateral forefoot passage 694.

When assembled, article 610 preferably has ball control elements projecting from upper 618. Preferably, first ball control element 272 extends from between fifth portion 630 and sixth portion 632; second ball control element 274 extends from between third portion 626 and fourth portion 628; third ball control element 276 extends from between first portion 622 and second portion 624; lateral element 284 extends from lateral ball control passage 684; medial element 280 extends from medial ball control passage 680; medial forefoot element 290 extends from medial forefoot passage 690; and lateral forefoot element 294 extends from lateral forefoot passage 694.

Article 610 can have any combination or arrangement of ball control elements protruding through upper 618 and should not be read as being limited to the illustrated arrangement. Accordingly, different embodiments of article 610 can have different arrangements of the ball control passages and the ball control elements. For example, one embodiment can have an article of footwear with ball control elements only provided on the lace area of the bootie. In another example, an embodiment can include an article having only medial ball control elements. Preferably, ball control elements are provided at portions of the upper that may contact another surface.

Preferably, a user can select a particular bootie from a number of available candidate booties. Preferably, all of the candidate booties of a particular size, or range of sizes, are configured to associate with a corresponding shell of a matching size. In other words, a shell of a particular size is configured to receive multiple candidate booties of a compatible size. Each bootie can be selected by the user according to the type of ball control elements on the bootie. For example, some ball control elements can have a greater stickiness to work with a certain type of ball. Other ball control elements can be preferably used in different types of weather. For example, a user can have a choice between a dry-use bootie, a wet-use bootie, and a mud bootie.

In addition to different ball control elements, different booties can preferably have different structural properties to allow for foot size differences. For example, if a user chooses a size 10 article, the user may find the fit too loose. The user can then use a bootie that has a thicker foot cover to compensate. Likewise, an article that is too tight can receive a bootie having a thinner foot cover. Thus, an individual article can receive different booties to have a different fit for a user.

Other structural differences can include the amount of foot covered. For example, foot cover 210 of FIG. 2 may only cover a top or toe portion of a foot. Other embodiments can include booties that surround the foot. A bootie that surrounds the foot can provide more area for ball control elements. In addition, a full foot bootie can keep the foot warm or dry, depending on the embodiment.

In addition to different bootie embodiments, the user can select from different embodiments of shells. In various embodiments, the user may desire a shell having large cleats, small cleats, or any other arrangement of cleats. In addition, some embodiments can have booties with high tops or low tops. In another embodiment, a shell may be provided that is light weight. Accordingly, the user can ultimately select an article of footwear from both a bootie and a shell.

Figure 9:
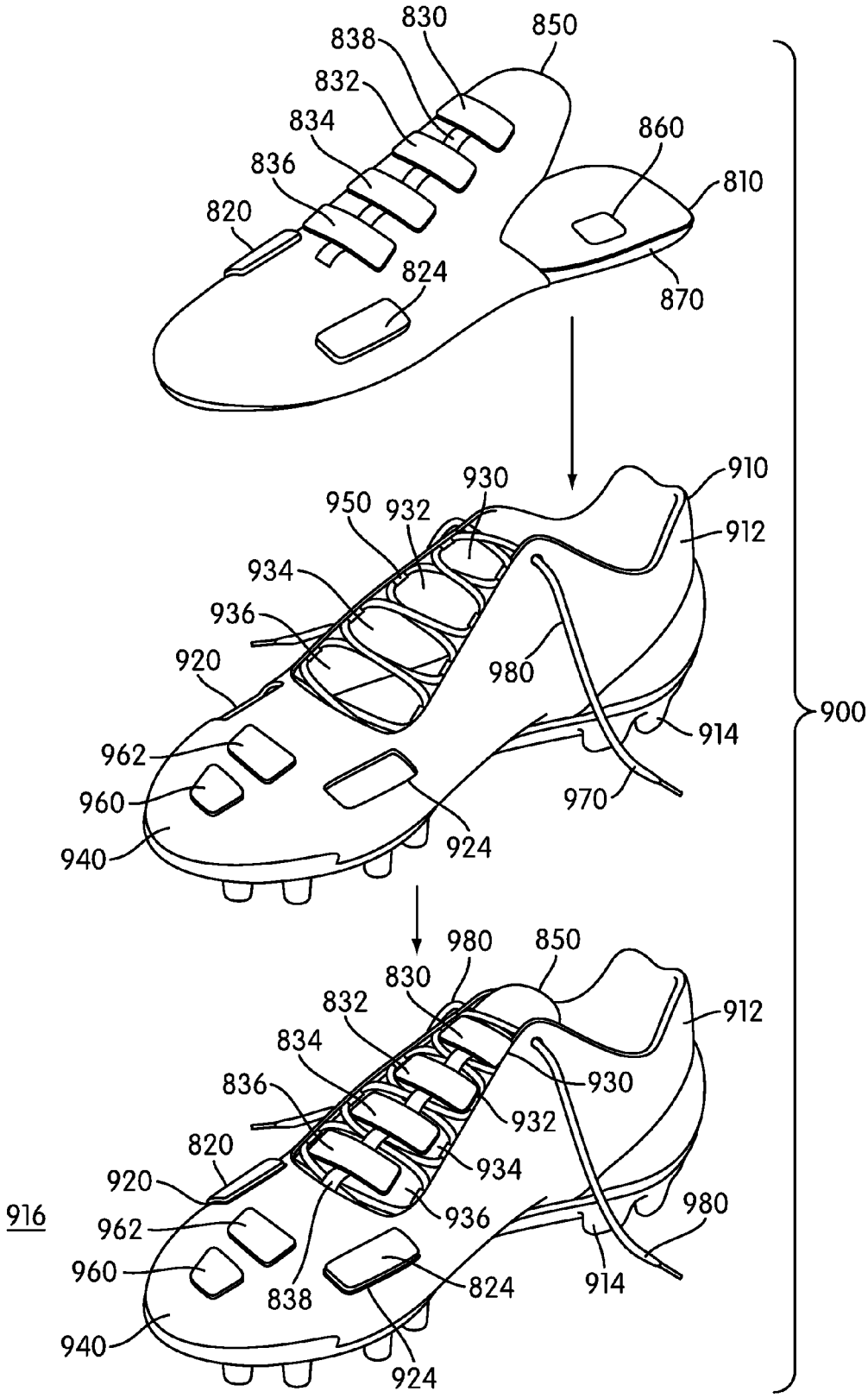
FIG. 9 is a diagram of an article according to a preferred embodiment.

FIG. 9 is a diagram of a preferred embodiment of article 900. Referring to FIG. 9, article 900 includes bootie 810 and shell 910. Shell 910 preferably includes upper 912 and sole 914. Shell 910 includes first forefoot ball control element 960 and second forefoot ball control element 962. In addition, lace area 950 is provided on upper 912. In other embodiments, shell 910 can include any arrangements of ball control elements.

In addition, bootie 810 can include lateral ball control element 820, medial ball control element 824, first lace ball control element 830, second lace ball control element 832, third lace ball control element 834, and fourth lace ball control element 836. In other embodiments, however, bootie can include any arrangement of ball control elements.

Bootie 810 preferably includes tongue 850. In some embodiments, first lace ball control element 830, second lace ball control element 832, third lace ball control element 834, and fourth lace ball control element 836 can be provided on tongue 850. In addition, lace receiving element 838 can be provided on tongue 850 to receive shoelace 970.

In addition, bootie 810 can include logo 860 provided on footpad 870. Similar to bootie 200 of FIG. 2, bootie 810 may include any of a cushion, reinforcement, and tread on a bottom of footpad 870.

First forefoot ball control element 960 and second forefoot ball control element 962 can be provided on forefoot portion 940 of shell 910. First forefoot ball control element 960 and second forefoot ball control element 962 can be permanently attached to shell 910. In other embodiments, first forefoot ball control element 960 and second forefoot ball control element 962 can be removable. In addition, shell 910 can include lateral ball control passage 920 through can receive lateral ball control element 820; medial ball control passage 924 which can receive medial ball control element 824; first lace portion 930 which can receive first lace ball control element 830; second lace portion 932 which can receive second lace ball control element 832; third lace portion 934 which can receive third lace ball control element 834; and fourth lace portion 936 which can receive fourth lace ball control element 836. That is, shell 910 can be configured to direct shoelace 970 around ball control elements on a received bootie. Different embodiments of article 900 can receive any number of different booties to possess different types of lateral, medial and lace ball control elements.

Assembled article 916 includes bootie 810 associated with shell 910. As can be observed, the ball control elements of bootie 810 extend through shell 910. Shoelace 970 is illustrated as being received in lace receiving element 838. In some embodiments, however, lace receiving element 838 may not be employed to allow for faster removal of a bootie from a shell.

While a complete article of footwear or a shell may be expensive, sets of booties can be considerably cheaper. Therefore, the intended user need only purchase one shell, and may then purchase many different bootie sets. Different bootie sets allows the user a wide range of variations in fit and ball control element styles by wearing different booties with a shell. Additionally, because changing from one bootie set to another bootie set is easy, the user can change article characteristics at any time. For example, if rain develops just before a game begins, the user of the article can easily switch from a dry weather bootie to a wet weather bootie.

Figure 10:
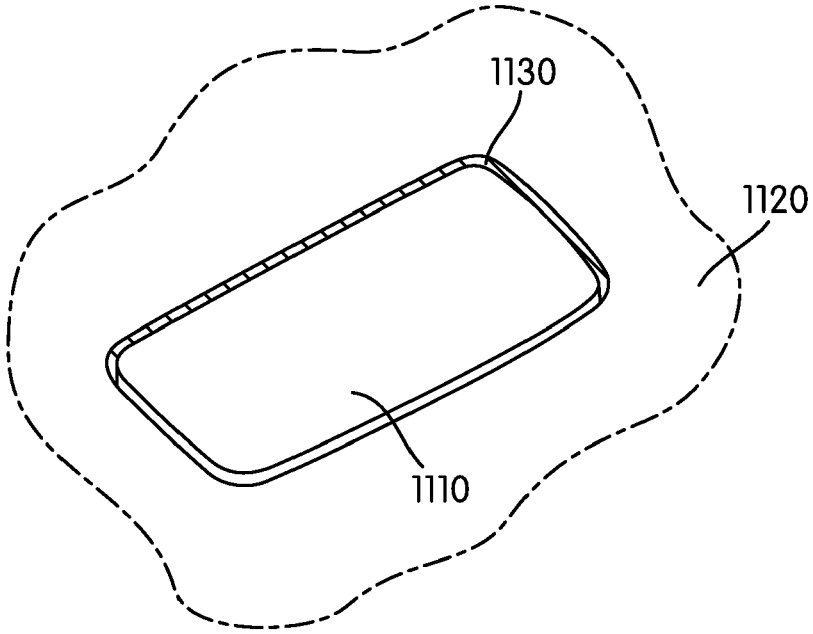
FIGS. 10 and 11 are schematic diagrams of preferred embodiments of ball control elements.

FIG. 10 is a schematic diagram of a preferred embodiment of ball control element 1110. Referring to FIG. 10, ball control element 1110 is provided on bootie 1130. Ball control element 1110 is shown as being received in shell 1120. Outer surface of ball control element is preferably flush with the outer surface of shell 1120.

Figure 11:
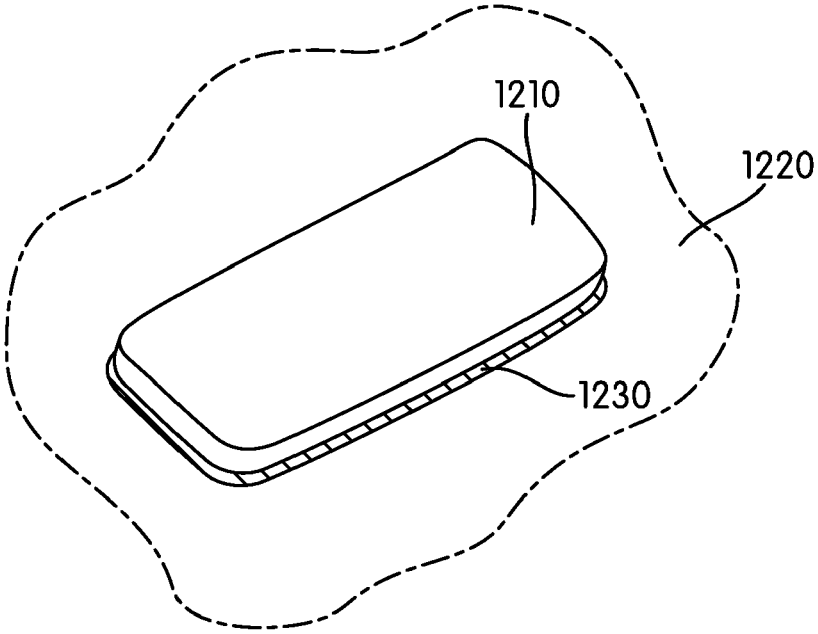

FIG. 11 is a schematic diagram of a preferred embodiment of ball control element 1210. Referring to FIG. 11, ball control element 1210 is provided on bootie 1230. Ball control element 1210 is shown as being received in bootie 1220. Outer surface of ball control element preferably extends outward from the outer surface of bootie 1220.

Figure 12:
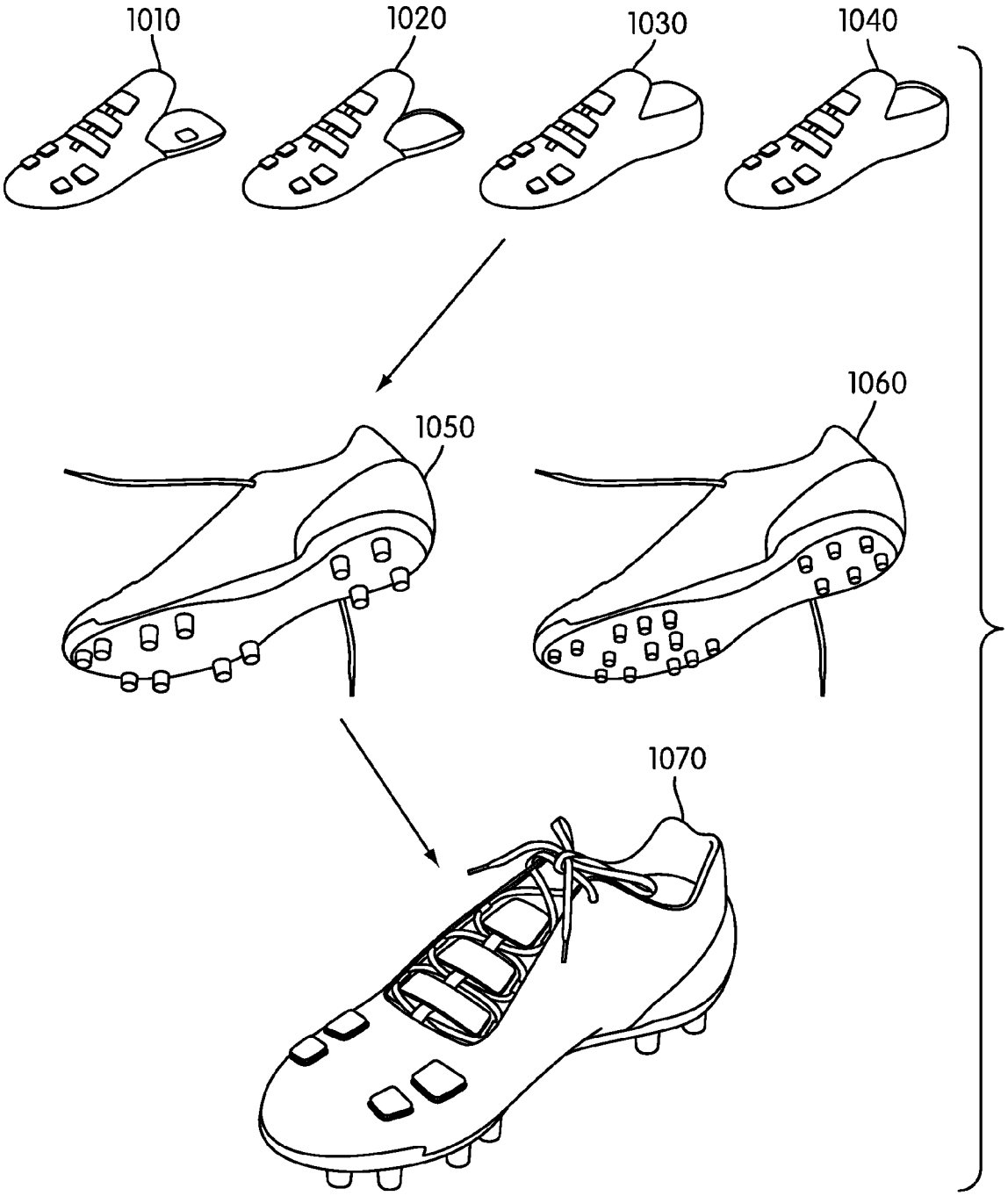
FIG. 12 is a diagram of a system of selecting an article of footwear according to an embodiment.

FIG. 12 is a diagram of a system of selecting an article of footwear according to an embodiment. Referring to FIG. 12, a user can select from several different elements to create a custom article of footwear. As can be observed, the user can choose from first bootie 1010, second bootie 1020, third bootie 1030, or fourth bootie 1040. However, any number of different booties can be available for the user to choose.

Each of first bootie 1010, second bootie 1020, third bootie 1030, and fourth bootie 1040 can have different arrangements and properties. For example, according to an embodiment, first bootie 1010 can have dry weather ball control elements. On the other hand, the user can select second bootie 1020 because second bootie 1020 is an embodiment having ball control elements designed for wet weather. It can also be observed that first and second bootie 1010 and 1020 have a partial foot cover.

On the other hand, the user may also choose from the styles of third bootie 1030 and fourth bootie 1040. Third bootie 1030 and fourth bootie 1040 both have full covered foot areas. In one embodiment, third bootie 1030 can be water proof and have wet weather capable ball control elements. Similarly, fourth bootie 1040 can be thicker to create a snugger fit. Fourth bootie 1040 can also have dry weather ball control elements.

In some embodiments, a system of selecting an article of footwear can include different provisions to cushion a foot. For example, in some embodiments, different booties may include cushion portions. The configuration of a cushioning portion for a bootie can depend on an intended playing condition. In some embodiments, a dry weather bootie may have more cushioning than a wet weather embodiment. Preferably, a dry weather bootie such as first bootie 1010 can include a cushion portion, for example cushion 240 of FIG. 3. Preferably, a wet weather bootie such as third bootie 1030 has no cushioning element.

First shell 1050 and second shell 1060 are preferably configured to associate first bootie 1010, second bootie 1020, third bootie 1030, and fourth bootie 1040. Preferably, first shell 1050 and second shell 1060 have ball control element receiving portions that correspond to ball control elements on first bootie 1010, second bootie 1020, third bootie 1030, and fourth bootie 1040. Accordingly, the user can choose from either of first shell 1050 and second shell 1060 into which any of first bootie 1010, second bootie 1020, third bootie 1030, and fourth bootie 1040 can be inserted and worn.

In addition, first shell 1050 can be an embodiment having large cleats that are spaced apart while second shell 1060 has smaller cleats that are spaced closer together. It can also be observed that second shell 1060 is a high top model while first shell 1050 is a low top model.

Different combinations of first bootie 1010, second bootie 1020, third bootie 1030, or fourth bootie 1040 and first shell 1050 or second shell 1060 can be associated to create different articles of footwear. It can be observed that third bootie 1030 and first shell 1050 have been joined to create article 1070. Accordingly, article 1070 has a large cleats and a full foot cover area with dry weather ball control elements.

However, it can be understood that in a preferred embodiment, the user can have many more options available. The options can include many different styles of booties and shells.

Figure 13:
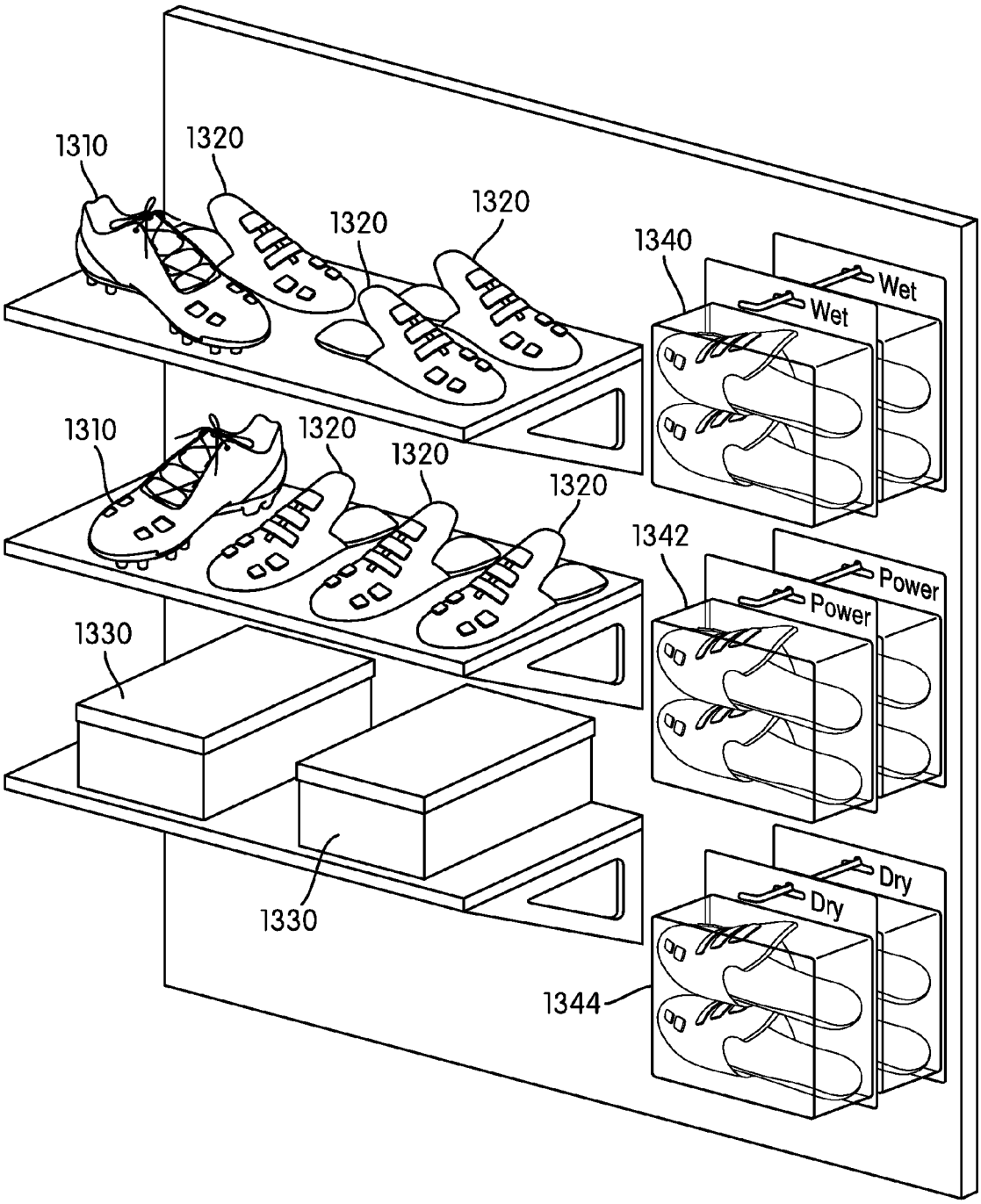
FIG. 13 is a schematic diagram of a retail system according to a preferred embodiment.

FIG. 13 is an illustration of a preferred embodiment of a retail system. Referring to FIG. 13, shells 1310 are sold simultaneously sold with booties 1320. In this embodiment, the retail system is a wall section. In a preferred embodiment, this wall would be a portion of a sneaker section in a store. Shells 1310 and booties 1320 are shown generically in FIG.

13 only for the purpose of illustration. In some embodiments, these shells and booties can be different styles, colors, and arrangements of ball control elements.

In addition, in a preferred embodiment, shells 1310 can be prepackaged in boxes 1330. Boxes 1330 can contain a set of shells that are marked for shoes size, cleat or tread style, and footwear style, such as hightops or running shoes. Shells 1310 are illustrated as being sold in boxes 1330, however shells 1310 can be sold in any style, packaging, or manner desired.

Packages of booties 1320 can be sold along side boxes 1330. FIG. 13 illustrates an example in which booties 1320 are sold in plastic hanging packages. For example, booties could be sold in packages, including wet bootie packages 1340, power shoe bootie packages 1342, and dry use bootie packages 1344. However, booties 1320 can be sold in any arrangement or packaging desired. The retail wall system of FIG. 13 allows the user to easily purchase different shell styles and their respective booties.

Using a retail system, a user could select a shell and select booties from a group of candidate bootie sets that have been prepackaged. By associating a bootie of the selected bootie candidate group with a selected shell, the user has a modified article of footwear to provide varying degrees of fit, appearance, and ball control.

In some situations, it may be preferable for a user to purchase multiple pre-packaged bootie sets at one time. Using a retail system, such as the embodiment illustrated in FIG. 13, a user could purchase two different shells 1310 and two different booties 1320. This purchase would provide the user with four different variations in the type of article of footwear that could be obtained through the interchange of booties 1320 and shells 1310.

Referring to FIGS. 12 and 13, a user can be likewise be presented with a retail system where first bootie 1010, second bootie 1020, third bootie 1030, or fourth bootie 1040 can be presented in wet bootie packages 1340, power shoe bootie packages 1342, and dry use bootie packages 1344 and first shell 1050 and second shell 1060 are presented in boxes 1330. In a retail system having four bootie styles and two shell styles, the user is provided with eight different variations of an article of footwear without the expense of purchasing eight different articles of footwear.

In addition, in another embodiment of the retail system, first bootie 1010, second bootie 1020, third bootie 1030, or fourth bootie 1040 can be sold having different appearances. By selecting different booties, the user may change the appearance of completed article of footwear 1070. For example, each of first bootie 1010, second bootie 1020, third bootie 1030, or fourth bootie 1040 can have different colors, patterns, logos, or customized appearances. Similarly, in some embodiments, shells may also be provided that have different appearances.

In some embodiments, a retail system can include provisions to customize an article of footwear or a bootie. For example, in some embodiments, a customized appearance article may be selected from a website. A customer may select custom colors, writing, control element, stitching, and patterns to be provided on a custom article of footwear or bootie. For example, commonly assigned U.S. patent application Ser. No. 09/721,445, filed Nov. 11, 2000, describes a custom fit system.

In some embodiments, a retail system may include provisions to retrieve either of a custom article of footwear or bootie. For example, a customer's foot may be measured. The customer's measurements can then be stored in a database. The customer can then purchase a custom fit or preferred fit article of footwear by accessing the database. For example, a customer's preferred fit may be provided on a portable storage device or access card. For example, a customer may simply access an account on a website. Preferably, a customer may simply provide an ID card at retail location to receive custom fit or preferred fit articles of footwear and booties. Commonly assigned U.S. patent publication 2007/003750, filed on Aug. 12, 2005, published on Feb. 15, 2007, describes an online retail system and a customer database. The methods and systems described in the two prior applications could be adapted for use with embodiments of the retail system and articles of footwear and booties described above. U.S. patent publication 2007/003750 and U.S. patent application Ser. No. 09/721,445 are incorporated by reference in their entirety.

Accordingly, various embodiments of the present invention will help a user to control the interaction of an article of footwear with surfaces. A user can change booties to change the surface interaction quality of the article. In addition, an article of footwear can be provided with a number of compatible booties to change the fit, feel, appearance, and behavior of the article. Thus, the present invention provides an elegant solution by allowing an article of footwear to have many different qualities at a lower cost than purchasing separate articles of footwear.

While various embodiments of the invention have been described, it will be apparent to those of ordinary skill in the art that may more embodiments and implementations are possible that are within the scope of the invention.

What is claimed is:

1. An article of footwear, comprising:

a bootie;

a shell configured to receive the bootie, wherein the shell includes a shell sole and a shell upper;

a shoelace received by the shell upper;

a ball control element provided on a tongue of the bootie, so that the ball control element is positioned proximate the shoelace when the bootie is received in the shell, wherein the ball control element includes a ball control surface which is configured to interact with a surface in a predetermined manner; and a lace area opening defined in the shell upper, wherein, when the bootie is received in the shell, the shoelace extends along a perimeter of the ball control element in order to avoid the ball control element, and the ball control element is aligned with and protrudes through the lace area opening and the shoelace so that the ball control element extends outward from the lace area opening and the shoelace when the bootie is received in the shell.

2. The article of footwear of claim 1, wherein the bootie comprises a bootie sole and a foot cover, wherein the foot cover is attached to the bootie sole and configured to receive a foot.

3. The article of claim 2, wherein the bootie sole includes at least one tread element provided on a bottom surface of the bootie sole.

4. The article of claim 3, wherein the tread element is configured to be associated with an inner surface of the shell.

5. The article of claim 2, wherein the bootie sole includes a reinforcement member configured to strengthen the bootie sole.

6. The article of claim 2, wherein the bootie sole includes a cushioning member.

7. The article of claim 2, wherein the foot cover is configured to at least partially cover the foot.

8. The article of footwear of claim 2, wherein the bootie is configured to be worn separately from the shell.

9. The article of claim 1, wherein the shell comprises a plurality of lacing elements that each receive the shoelace.

10. The article of claim 1, further comprising an additional ball control element provided on an outer surface of the shell.

11. The article of footwear of claim 1, further comprising a plurality of forefoot ball control elements associated with the bootie in a forefoot region of the bootie, wherein the shell upper includes a plurality of forefoot ball control passages, wherein each of the plurality of forefoot ball control passages is configured to receive one of the plurality of forefoot ball control elements.

12. The article of footwear of claim 1, wherein the bootie comprises a lacing element that receives the shoelace.

13. An article of footwear comprising:

a shell having a sole and an upper attached to the sole;

a shoelace received by the upper;

a group of booties;

wherein each of the booties has a ball control element on a tongue of the bootie so that the ball control element is positioned proximate the shoelace when the bootie is received in the shell, wherein each ball control element includes a ball control surface which is configured to interact with an external surface in a predetermined manner;

wherein each of the booties is configured to be received in the upper;

wherein, when a bootie selected from the group of booties is received in the shell, the shoelace extends along a perimeter of the ball control element in order to avoid the ball control element;

a lace area opening provided in the upper to receive the ball control element so that the ball control element protrudes through the upper and the shoelace when a bootie selected from the group of booties is received in the shell; and wherein each bootie of the group of booties is manufactured to have a different style of ball control element so that the booties may be interchanged with each other to accommodate different playing conditions.

14. The article of footwear of claim 13, wherein the sole includes a cleat.

15. The article of footwear of claim 13, wherein the group of booties includes a bootie having the ball control element configured with characteristics selected from the group consisting of accommodating wet conditions, increasing the power of kicking, increasing the accuracy of kicking, facilitating rock climbing, contacting a football, and contacting a soccer ball.

16. The article of footwear of claim 13, further comprising an additional ball control element provided on each of the booties and a ball control passage provided in the upper for receiving the additional ball control element when the bootie is received by shell.

17. The article of footwear of claim 13, further comprising a plurality of lacing elements disposed on the shell, wherein the shoelace is threaded through the lacing elements to avoid the ball control element.

18. The article of footwear of claim 13, wherein each of the booties has an adjacent ball control element positioned proximate the ball control element.

19. The article of footwear of claim 18, wherein, for each of the booties, the shoelace extends between the ball control element and the adjacent ball control element when the each bootie is received in the shell.

20. An article of footwear comprising:

a bootie;

a shell configured to receive the bootie;

a plurality of lacing elements disposed on the shell;

a shoelace for adjusting the fit of the shell, wherein the lacing elements receive the shoelace;

a ball control element provided on a tongue of the bootie, so that the ball control element is positioned proximate the plurality of lacing elements when the bootie is received in the shell;

wherein the shoelace extends along a perimeter of the ball control element in order to avoid the ball control element;

wherein the ball control element protrudes through the shell and the shoelace when the bootie is received in the shell.

21. The article of footwear of claim 20, wherein the bootie includes a foot pad and a foot cover, wherein the foot cover is configured to receive a top portion of a foot and the foot pad is configured to support a bottom portion of the foot, and wherein a foot cover thickness is configured to adjust the fit of the shell.

22. The article of footwear of claim 20, wherein the bootie includes a foot pad and a foot cover, wherein the foot cover is configured to receive a top portion of a foot and the foot pad is configured to support a bottom portion of the foot, and wherein the bootie includes a tread element disposed on the foot pad, wherein the tread element is configured to engage with the ground when the bootie is worn separately from the shell, and wherein the tread element is configured to engage with the shell when the bootie is worn with the shell.

23. The article of footwear of claim 20, further comprising an adjacent ball control element positioned proximate the ball control element, wherein the shoelace extends between the ball control element and the adjacent ball control element.

24. The article of footwear of claim 20, further comprising a second ball control element associated with the bootie in a forefoot region of the bootie, wherein the shell includes a ball control passage configured to receive the second ball control element when the shell receives the bootie.

25. The article of footwear of claim 20, further comprising a plurality of forefoot ball control elements associated with the bootie in a forefoot region of the bootie, wherein the shell includes a plurality of forefoot ball control passages, wherein each of the plurality of forefoot ball control passages is configured to receive one of the plurality of forefoot ball control elements.

* * * * *